US011421499B2

(12) United States Patent
Mora et al.

(10) Patent No.: US 11,421,499 B2
(45) Date of Patent: Aug. 23, 2022

(54) ACTUATOR RING LOCK PACKOFF ASSEMBLY WITH INTERLOCKING MANDREL HANGER

(71) Applicant: Valvulas del Pacifico, S.A., Quito (EC)

(72) Inventors: Henry Esteban Mora, Quito (EC); Paul Perez, Katy, TX (US)

( * ) Notice: Subject to any disclaimer, the term of this patent is extended or adjusted under 35 U.S.C. 154(b) by 0 days.

(21) Appl. No.: 16/844,164

(22) Filed: Apr. 9, 2020

(65) Prior Publication Data

US 2021/0317718 A1 Oct. 14, 2021

(51) Int. Cl.
*E21B 33/03* (2006.01)

(52) U.S. Cl.
CPC ..... *E21B 33/03* (2013.01)

(58) Field of Classification Search
CPC ..... E21B 33/03; E21B 17/046
USPC ..... 166/85.1
See application file for complete search history.

(56) References Cited

U.S. PATENT DOCUMENTS

| | | | | |
|---|---|---|---|---|
| 5,026,200 | A * | 6/1991 | van Bilderbeek | E21B 17/046 403/328 |
| 5,086,843 | A * | 2/1992 | Mims | F16L 25/08 175/320 |
| 5,755,310 | A * | 5/1998 | Wourms | B66B 9/025 187/267 |
| 6,811,190 | B1 * | 11/2004 | Ray | F23J 13/04 285/361 |
| 9,377,145 | B2 * | 6/2016 | Cruickshank | F16L 37/248 |
| 9,923,302 | B2 * | 3/2018 | Friesen | H01R 13/5202 |
| 10,693,251 | B2 * | 6/2020 | Ross | H01R 13/005 |
| 2011/0147009 | A1 * | 6/2011 | Dupal | E21B 17/043 166/380 |

* cited by examiner

*Primary Examiner* — Matthew R Buck
*Assistant Examiner* — Patrick F Lambe
(74) *Attorney, Agent, or Firm* — James Robert (Jim) Johnson

(57) ABSTRACT

The invention comprises an activator ring and locking ring usable to connect a variety of parts used in oil and gas field production operations. The invention further comprises connection elements integrated into oil and gas well pipeline parts, such as washing tools, pack off bodies, mandrel casing hangers and other pipeline parts to permit simplified and secure connections to improve well head operations. The oil and gas field parts and activator ring use a novel design for tabs, slots and fixing devices to secure the connection of production parts in the well head. The design allows simpler and safer connections of oil field equipment components.

4 Claims, 9 Drawing Sheets

ACTUATOR RING LOCK PACKOFF ASSEMBLY WITH INTERLOCKING MANDREL HANGER

BACKGROUND OF THE INVENTION

Drilling operations for oil wells involve the use of heavy equipment rotating at high speeds and under intense pressures and power. In a typical operation, drill bits are pushed into the earth and turned at high torque to cut through rock formations. As the bits drill deeper, additional lengths of drill pipe are added between the drive mechanism and the drill bit. Similar efforts are made and similar equipment is used to case and finish wells. Equipment inserted into oil wells is most commonly in the form of lengths of generally cylindrical pipes and tools able to fit into a cylindrical well hole. These parts must be releasably attached end to end to each other to form drill strings or working parts located in the well head.

At the well head, various tools are likewise connected together for use in oil well operations.

The most common method for attaching oil field components is the use of mated sets of helical threads. Parts are hoisted into position at the drilling site and one threaded component is spun at high speed onto its mated threaded counterpart component. Given the size and weight of these parts, workers are exposed to considerable risk of injury or death in the event of a mishap. Heavy equipment spun at high speed has a considerable amount of kinetic energy. In the event of a mistake, breakage or accident during operations, fast moving equipment can injure or kill workers.

There is a need in oil well drilling operations for an effective method of connecting oil field components quickly and more safely. The described invention meets these needs.

BRIEF DESCRIPTION OF THE INVENTION

The helical threads commonly used to connect oil well equipment together do more than simply connect two pieces of equipment. Threading the pieces together along the helical threads provides support along the longitudinal axis of the pieces, prevents flexing or bending of the parts and limits rotational motion of the parts relative to each other. Essentially, the threads are a ramp along which the parts are mated in order to press the threads of each against the threads of the other to create friction that limits independent motion of each piece in three dimensions. A threaded connection thus provides a strong connection based in part on the length of the threads relative to the length and diameter of the parts connected. In oil well operations, the limitation of the threaded connection is that one piece must be rotated using high energy to mate the two parts. The present invention provides similar support for the assembled pieces but without requiring high energy assembly.

In a preferred embodiment, the invention comprises an activator ring which can connect a piece of equipment above the activator ring to the activator ring and/or to a piece of equipment below the activator ring. Likewise, the activator ring, when used with an open lock ring, can position a connected tool in place in a well head. The activator ring has an upward/downward orientation, referred to as a "top" and a "bottom" as those terms are commonly used. The top connector of the activator ring comprises a slot on the interior surface of the activator ring and running parallel to the top of the activator ring. The activator ring further has disposed thereon a plurality of spaced gaps in the metal ridge between the top of the activator ring and the parallel slot that permit protrusions on the part to be connected to the top of the activator ring to allow coupling of the activator ring and the piece of equipment connected to the top of the activator ring. Equipment connected to the top of the activator ring may include a running and washing tool (generically, a "Top Tool"). The Top Tool comprises a neck sized to fit into the activator ring and protrusions on the sized neck. Each of the protrusions is sized to fit through one of the spaced gaps on the top of the activator ring and further, when the Top Tool and activator ring are rotated with respect to each other, to fit into the parallel slot on the top of the activator ring.

A tool commonly placed below a running and washing tool is a pack off body. Each embodiment of the invention comprises connectors to connect a pack off body to the bottom of the activator ring (referred to herein generically as the "Bottom Tool"). Using the top/bottom description of the orientation of the activator ring, the top of the Bottom Tool comprises a neck sized to fit into the activator ring. The neck of the Bottom Tool further comprises 4 z-shaped slots as shown in FIG. 3, described more fully below. To mate the activator ring to the Bottom Tool the activator ring has disposed through the body of the activator ring 4 screw holes into which are threaded 4 set screws. The 4 set screws are screwed partially into the holes in the activator ring. The neck at the top of the Bottom Tool is inserted into the bottom of the activator ring. The activator ring and Bottom Tool are oriented so that the set screw holes align with the z-shaped slots to permit the set screws to be threaded into the z-shaped slot, although until the Bottom Tool and activator ring are in their final alignment the set screws are not put into contact with the z-shaped slot of the Bottom Tool.

The activator ring is designed to limit motion between parts in two dimensions—along the longitudinal axis and flexing/bending. It does not fully limit rotational motion between the assembled parts. To prevent unwanted rotational motion, tools have sets of tab and corresponding holes at their connection points to mate pieces in place.

The invention further comprises an open ring disposed between the Bottom Tool and the bottom of the activator ring. Once the set screws of the activator ring are tightened (after the Bottom Tool and activator ring are finally aligned), an open lock ring is expanded around a narrowing on the bottom of the activator ring and released to tighten around the bottom of the activator ring to retain the activator ring in place with the Bottom Tool.

The activator ring assembly can also be designed with "J" slots. However, in the primary embodiment, horizontal slots and stops for the engagement of the activator ring to run the Bottom Tool are used.

The open lock ring is positioned during mounting between the activator ring and the Bottom Tool. Once the Bottom Tool is landed inside the well head, the assembly is rotated to activate the activator ring assembly which in turn will engage the open lock ring and position the ring into a machined groove disposed inside the wellhead.

The invention may be used with a variety of well head tools. That is, multiple activator rims may be used in succession to connect a plurality of tools one after the other. For this, the top of each tool must comprise invention elements to connect to the bottom of an activator ring and the bottom of each tool must incorporate connection elements to connect to the top of an activator ring. These alternative embodiments are described hereinbelow.

FIGURES

DETAILED DESCRIPTION OF THE INVENTION

Figure 1:
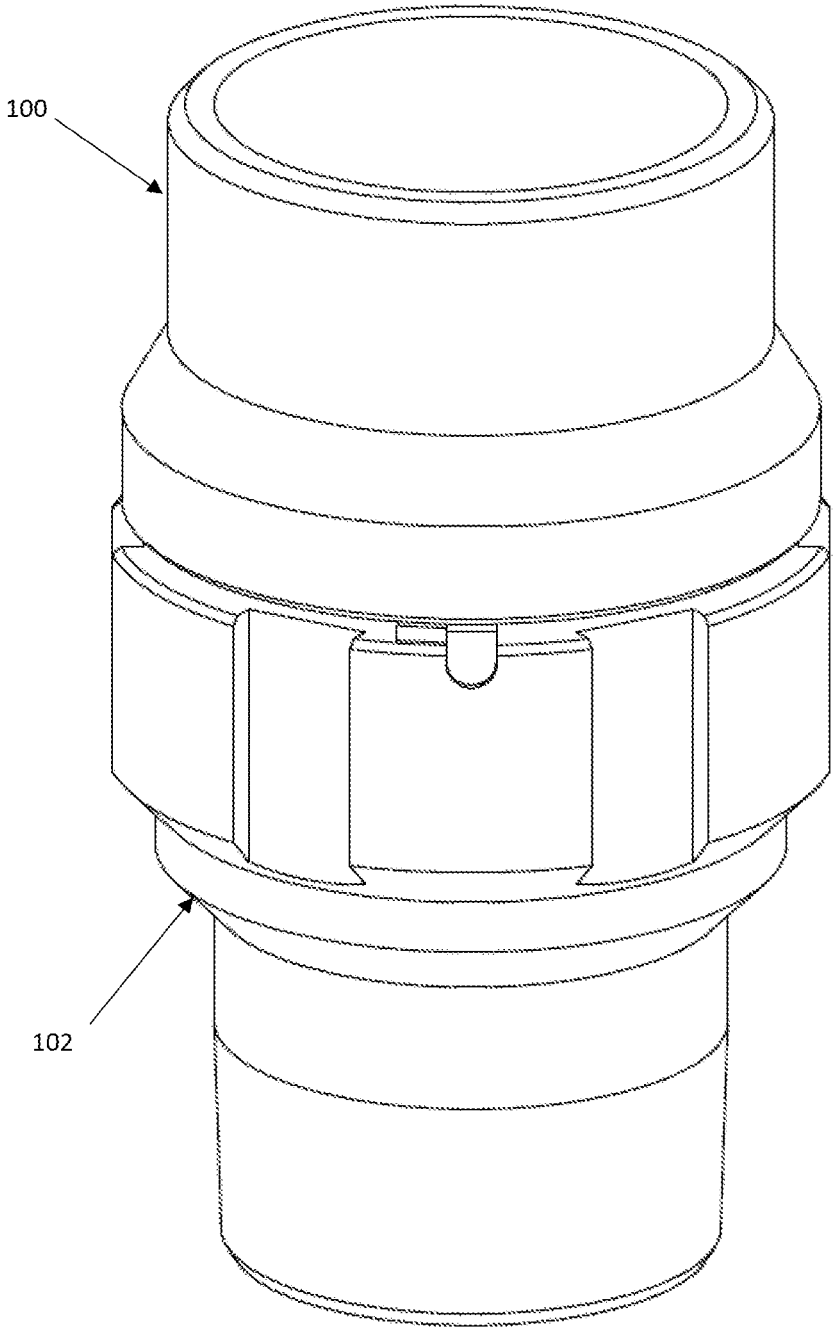
FIG. 1 depicts a perspective view of a threaded casing hanger running tool and casing hanger known in the industry in which the parts are threaded together.
Figure 2:
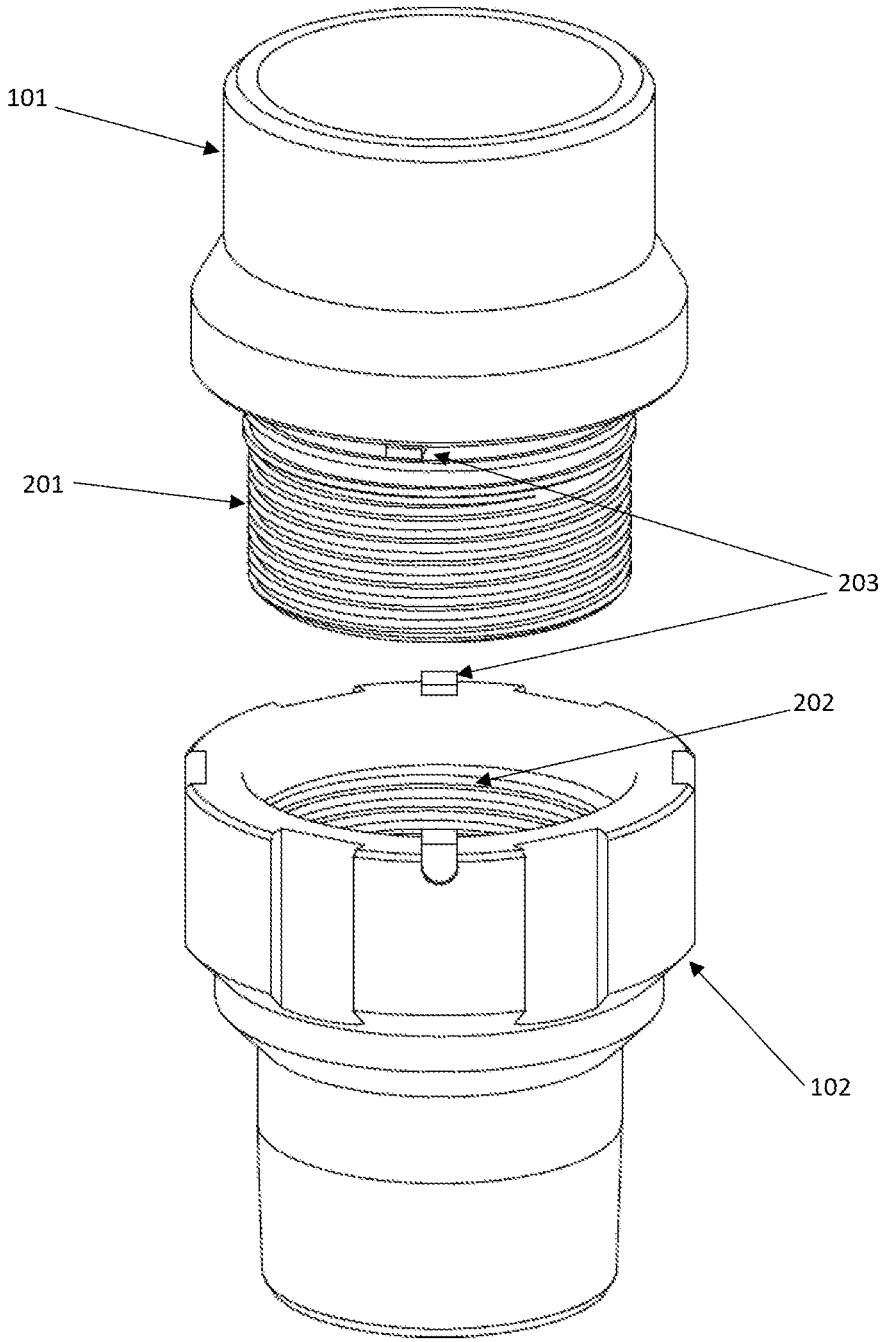
FIG. 2 depicts the same perspective view of a threaded casing hanger running tool and casing hanger known in the industry in which the parts are not threaded together.

Referring first to FIG. 1, the standard male/female threaded running tool connectors in oil well drilling equipment commonly known in the industry are depicted. A threaded male connector 101 on a piece of equipment is connected to a mated threaded female connector 102 on a running tool. While the connection is simple in design, the method for connecting these pieces of equipment is to rotate one at high speed while either holding the other in a fixed position or by counter-rotating the other. It is noted that FIG. 1 and FIG. 2, described below, illustrate the operational aspects of these parts. These parts in practice commonly comprised long lengths of pipe having disposed at each end thereof one of these types of connectors (one male and one female). Taking into account the need to spin a piece of equipment weighing hundreds of pounds at high speed, the risk raised in using a simple design is clear. Referring also to FIG. 2, the male threads 201 of the threaded male connector 101 are depicted. FIG. 2 also depicts the female threads 202 of the threaded female connector 102. These pieces of equipment are typically fixedly connected to one or more parts weighing, potentially, hundreds of pounds. It is understood that it takes a considerable amount of energy to rotate such heavy objects at high speed to connect them. If the rig crew loses control or if a piece of equipment breaks during the threading operation, the potential for injury is high. The running tools used for running the casing mandrel hangers are designed with right hand threads 201 and 202 and interference tabs 203 designed to limit full thread engagement of the parts. This results in a need to operate the drill string to which these parts are attached at lower speeds. The evident simplicity of connecting tools and other equipment using threads hides the risks raised by the complexity of performing the tasks necessary to connect those parts.

Figure 3:
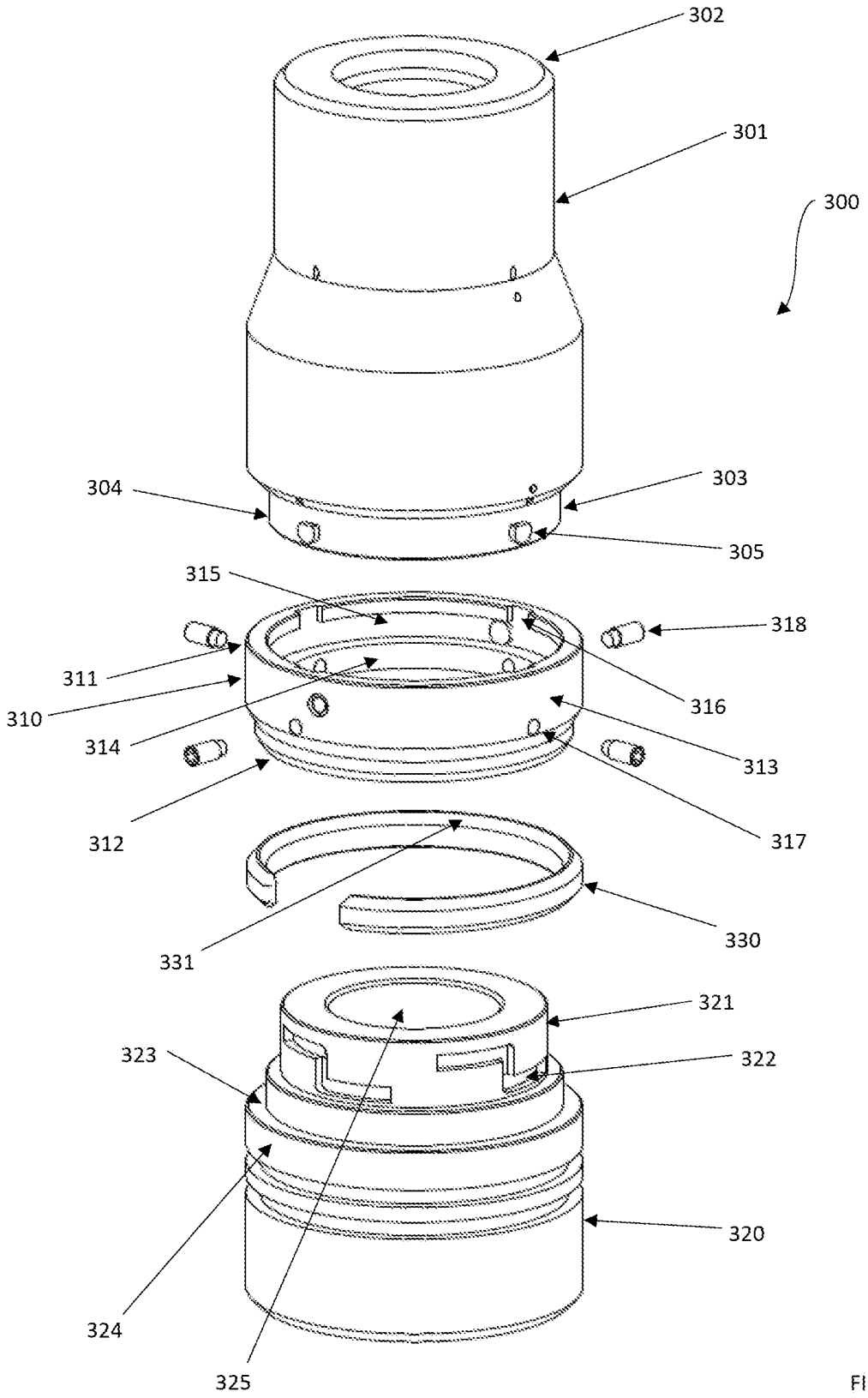
FIG. 3 depicts an exploded perspective view of the elements of one embodiment of the invention.

Referring now to FIG. 3, the parts of the primary embodiment of the invention 300 are disclosed. The invention 300 comprises an upper mounting piece 301, which may be a running and washing tool, such as depicted in FIG. 3. Upper mounting piece 301 is generally in the form of a hollow cylinder and has a first end 302 which is designed to connect to a pipe used in the industry and a second end 303. In some embodiments the upper mounting piece 301 has integrated into it and extending upward from first end 302 a length of pipe known in the industry. The design of the first end 302 of the upper mounting piece 301 is not an aspect of the invention 300. The second end 303 of the upper mounting piece 301 is shaped to form a narrow neck 304 suitable to be inserted into the next element of the invention 300. Disposed on the neck 304 of the mounting piece 303 is a plurality of tabs 305 which are shaped protrusions. Each tab 305 is spaced on the neck 304 equidistant from the next two closest tabs 305. The neck 304 on the second end 303 of the upper mounting piece 301 may have disposed thereon 3 or more tabs 305, although 4 tabs 305 is typical. The number of tabs 305 generally is dependent on the diameter of the drilling equipment.

Referring still to FIG. 3, the invention 300 further comprises an activator ring 310. Activator ring 310 has, generally the shape of a hollow cylinder and has a first end 311 and a second end 312. The first end 311 of the activator ring 310 has an inner diameter sufficient to allow it to be securely mated to the neck 304 on the second end 303 of the upper mounting piece 301. The activator ring 310 has an outer surface 313 and an inner surface 314. The activator ring 310 has a thickness between the outer surface 313 and the inner surface 314 thick enough to permit the slots and holes described below to be suitable for use.

Cut into the inner surface 314 of the activator ring 310 is a horizontal slot 315 with a plurality of vertical entry slots 316. The horizontal slot 315 and vertical entry slots 316 are sized and positioned on the activator ring 310 to permit the insertion of neck 304 of the second end 303 and the tabs 305 of the upper mounting piece 301 into the first end 311 of the activator ring 310. The horizontal slot 315 and vertical entry slots 316 have a sufficient depth to be functional to secure the activator ring 310 to the upper mounting piece 301.

Upper mounting piece 301 is constructed of a durable steel known in the oil well drilling industry so as to be sufficiently hard and strong enough for its intended purpose. Tabs 305 are similarly sized for their intended use. Likewise, the activator ring 310 is durably constructed for its intended use. It is known in the oil well drilling industry and other industries in which wells are drilled that drill bits of different diameters (allowing holes of different sizes to be drilled) are used. Construction of the parts of the invention is gauged to meet known requirements in the industry for the durability of equipment depending on the size of the borehole to be drilled.

The activator ring 310 further has disposed therein a plurality of threaded holes 317 cut completely from the outer surface 313 to the inner surface 314 of the activator ring 310. The threaded holes 317 are sized to permit the insertion of set screws 318 into the activator ring 310. The threaded holes 317 are positioned equidistant from each other on an imaginary circumferential line across the outer surface 313 of activator ring 310.

Still referring to FIG. 3, the invention 300 further comprises a lower mounting piece 320. Lower mounting piece 320 is generally a hollow cylinder in shape and has cut or cast into it an upper neck 321 sized to be inserted into the second end 312 of the activator ring 310 for releasable attachment. Cut or cast into upper neck 321 of the lower mounting piece 320 are a plurality of "Z" shaped slots 322 (generally called "Z slots"). The number of Z slots 322 equals the number of threaded holes 317 on activator ring 310. Each Z slot 322 is shaped as shown in FIG. 1. That is, each Z slot includes an upper horizontal element (in which "horizontal" is relative to an imaginary vertical axis of the lower mounting piece 320 identified by approximating lower mounting piece 320 as a hollow cylinder), a vertical element integrated into one end of the upper horizontal element and a lower horizontal element integrated into the vertical element. The Z slots 320 are sized (width and depth) to allow insertion of set screws 318 in which a single set screw 318 is threaded through a threaded hole 317 and into in the upper horizontal element of a single Z slot 322. Further, the lower mounting piece 320 has an outer surface 324 and an inner surface 325. Further the thickness of the wall of the lower mounting piece 320 between the inner surface 325 and outer surface 324 is thick enough for the Z slot 322 to have a depth sufficient to be functional. Lower mounting piece 320 further comprises a ring surface 323 described in more detail below.

Figure 4:
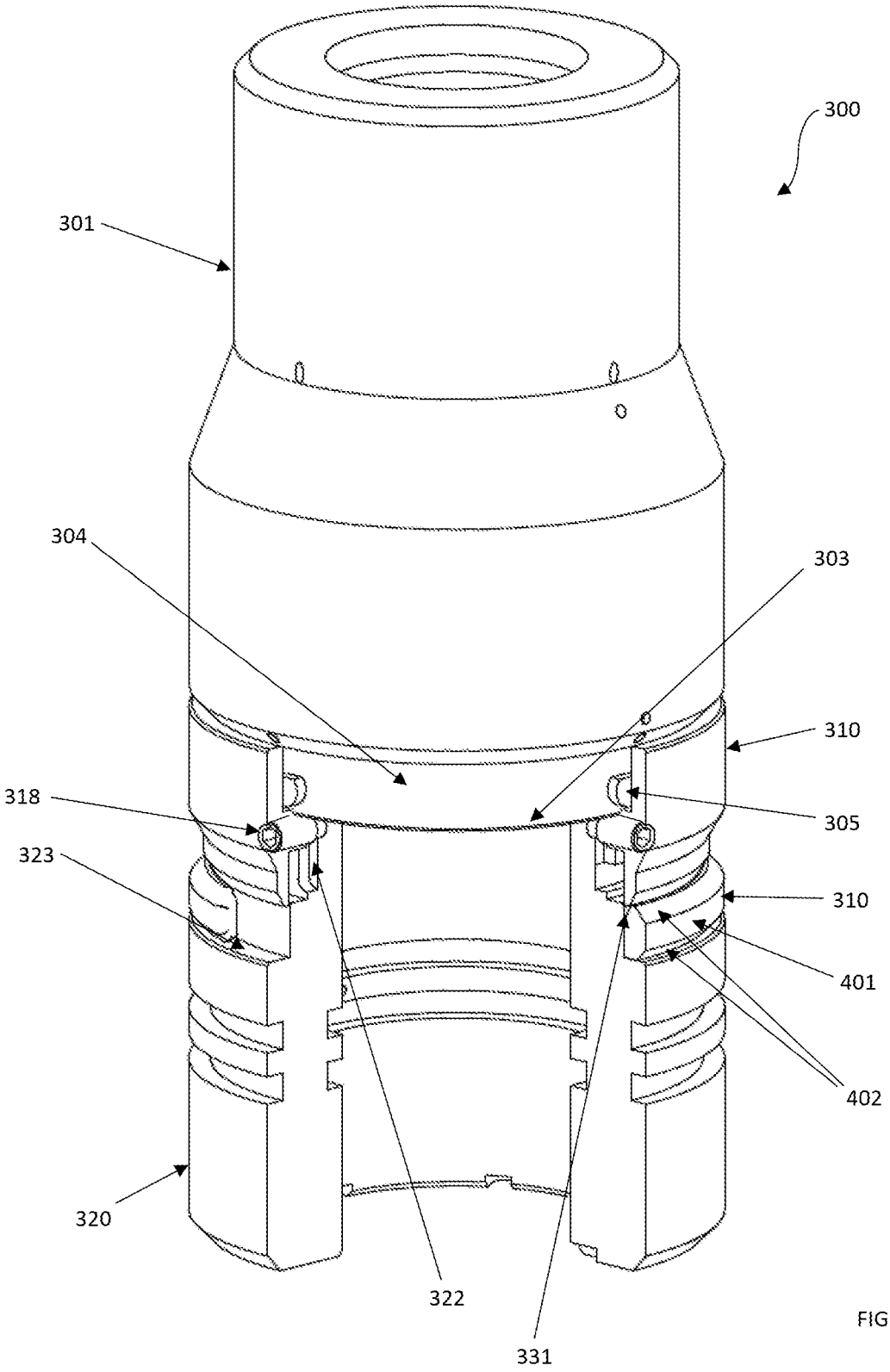
FIG. 4 depicts a perspective and partially cut-away view of the elements of the embodiment of the assembled invention.

Referring still to FIG. 3, the invention further comprises an open lock ring 330. Referring also to FIG. 4, the open lock ring 330 has an outer surface 401 and two angled surfaces 402. The cross-sectional shape of the open lock ring 330 is generally hexagonal. The open lock ring 330 has a thickness, a diameter and a gap in the open lock ring 330 such that when the open lock ring 330 is placed on ring surface 323 of the lower mounting piece 320 the outer diameter of the open lock ring 330 is not greater than the largest diameter of the lower mounting piece 320. Ring surface 323 is a horizontal surface disposed on lower mounting piece 320 suitable to retain the open ring lock 330 in place on the lower mounting piece 320. However, when the invention 300 is assembled and the open lock ring 330 is pressed into position (or "activated"), as described below, onto the second end 312 of the activator ring 310 the diameter of the open lock ring 330 exceeds the largest diameter of any other part, of the invention 300. Thus, the activated open lock ring 330 is expanded by this action to fit into a machined groove inside a well head (see FIG. 7).

FIG. 4 depicts the components of the invention 300 assembled for use. Referring to FIG. 3 and FIG. 4 together, one embodiment of the invention 300 is assembled as follows: on an oil well drilling rig, an upper mounting piece 301 is raised into position to permit attachment of a tool. Each of the vertical entry slots 316 of the activator ring 310 are aligned to each of the tabs 305 of the upper mounting piece 301, thus allowing insertion of the neck 304 into the activator ring 310. The activator ring 310 is then rotated to move the tabs 305 away from the vertical entry slots 316 and into the horizontal slot 315.

Next, one set screw 318 is threaded partially into each of the threaded holes 317. At this time, the inserted ends of the set screws 318 do not extend beyond the inner surface 315 of the activator ring 310. Next, open lock ring 330 is placed on ring surface 323 of lower mounting piece 320. Then workers either lower the upper mounting piece 301 and activator ring 310 assembly onto the upper neck of lower mounting piece 320 or raise the lower mounting piece 320 and open lock ring 330 assembly up into the activator ring 310. The parts are aligned so that the set screws 318 can be threaded but not tightened into the upper horizontal element of the Z slots 322 of the lower mounting piece 320.

With the parts of the invention 300 assembled, the invention 300 is lowered into the wellhead housing until it bottoms. The drill string is again slightly rotated to turn the upper mounting piece 301 and activator ring 310 relative to the lower mounting piece 320 until the set screws 318 reach the vertical element of each of the Z slots 322. The weight of the parts causes the set screws 318 to drop down the vertical element of each of the Z slots 322 to the lower horizontal elements of the Z slots 322. The upper mounting piece 301 and activator ring 310 assembly thus bottom into the lower mounting piece 320 causing the open lock ring 330 to expand and lock into place on the second end 312 of the activator ring 310. This occurs when the second end 312 of the activator ring 310 is pressed into and under the angled surface 331 of the open lock ring 330. The upper mounting piece 301 and activator ring 310 are again rotated until the set screws 318 are pushed to the end of the lower horizontal element of the Z slot 322. The set screws 318 are then tightened. At this point, the upper mounting piece 301 may be removed.

FIG. 4 depicts the elements of the invention 300 oriented such that the set screws 318 are proximal to the vertical element of the Z slots 322.

Figure 6:
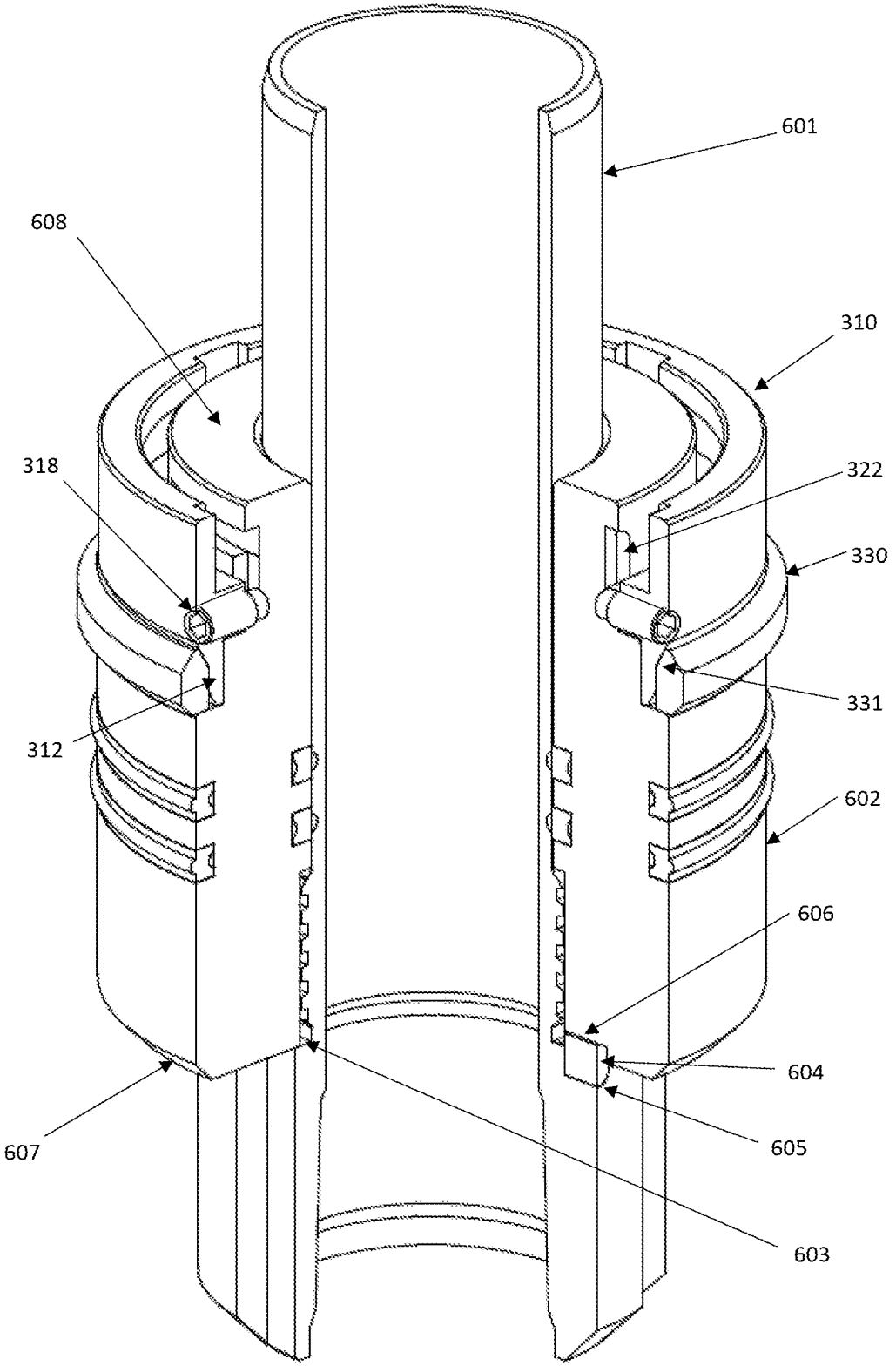
FIG. 6 depicts a perspective cutaway view of a second alternative embodiment of the invention.
Figure 10:
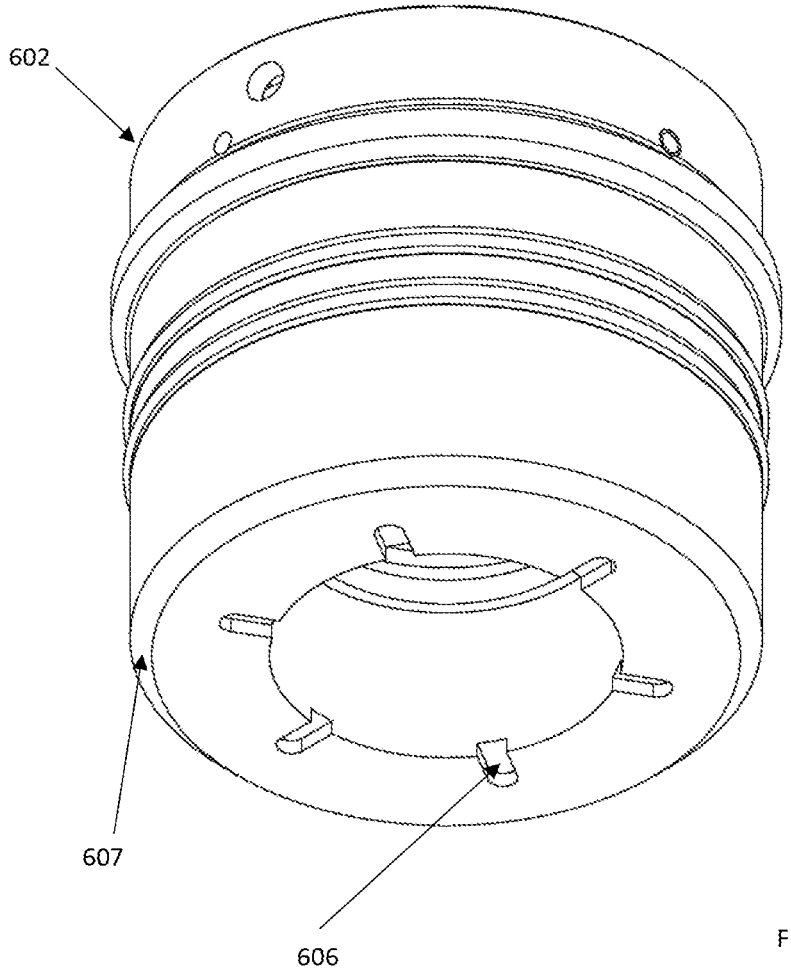
FIG. 10 depicts a lower perspective view of the upper pack off showing machine slots therein.

FIG. 4 depicts a preferred embodiment of the invention 300 but not the only embodiment. Referring now to FIG. 6, a cut-away view of a second alternate embodiment is depicted. Here, an upper casing hanger 601 and an upper pack off 602 are shown. The upper casing hanger 601 is of a design and function commonly known in the industry with the addition of a pack off base 603, which is a flat, horizontal surface on which the upper pack off 602 is disposed when assembled, as shown in FIG. 6. The upper pack off has a top end 608 and a bottom end 607. A plurality of tabs 604 are disposed in a plurality of tabs holes 605 disposed in the pack off base 603. A similar plurality of pack off tab slots 606 are disposed on the bottom end 607 of the upper pack off 602 as depicted in FIG. 6. Referring briefly to FIG. 10, tab slots 606 are more clearly depicted. The plurality of tabs 604 are positioned as shown to prevent the rotation of the upper casing hanger 601 relative to the upper pack off 602 when the drill string to which these tools are attached is rotated during drilling operations. As depicted in FIG. 10, 6 tab slots 606 to hold 6 tabs 604 are typical but not required. The number of tabs 604 used depends generally on the diameter of the tool. Tab slots 606 are positioned equidistant from each other and are positioned to align with the tab holes 605 of the pack off base 603.

Toward the top end 608 of the upper pack off 602 there is disposed a plurality of Z slots 322 as previously described in lower mounting piece 320 of the preferred embodiment. Activator ring 310 is attachable to the upper pack off 602 in the same manner as previously described in this specification using set screws 318.

FIG. 6 further shows the open ring lock 330 in place. Referring to FIG. 3, FIG. 4 and FIG. 6 together, it is seen that the second end 312 of the activator ring 310 is in the form of an angled or wedged surface. Similarly, disposed on the inner surface of the open lock ring 330 is a similar angled surface 331. The second end 312 of the activator ring 310 is designed, during assembly of any embodiment of the invention 300, to underride the angled surface 331 of the open lock ring 330 when the set screws 318 disposed in the upper horizontal element of each of the Z slots 322, drop down the vertical element of each Z slot and into the lower horizontal element of each Z slot. This is seen in FIG. 4 and FIG. 6. Although different embodiments of the invention 300 are disclosed in FIG. 3 and FIG. 4 relative to FIG. 6, the operation of the invention 300 relative to these aspects are the same. In FIG. 6, the invention 300 has been rotated sufficiently to cause the plurality of set screws 318 to each be moved from the upper horizontal elements of the plurality of Z slots 322 to the lower horizontal elements thereof. In so doing, the second end 312 of the activator ring 310 under rode the angled surface 331 of the open lock ring 330. As a result, the open lock ring 330 is now disposed on the second end 312 of the activator ring 310. Although not shown in FIG. 6, the second alternate embodiment of the invention 300 is assembled using upper mounting piece 301.

Figure 5:
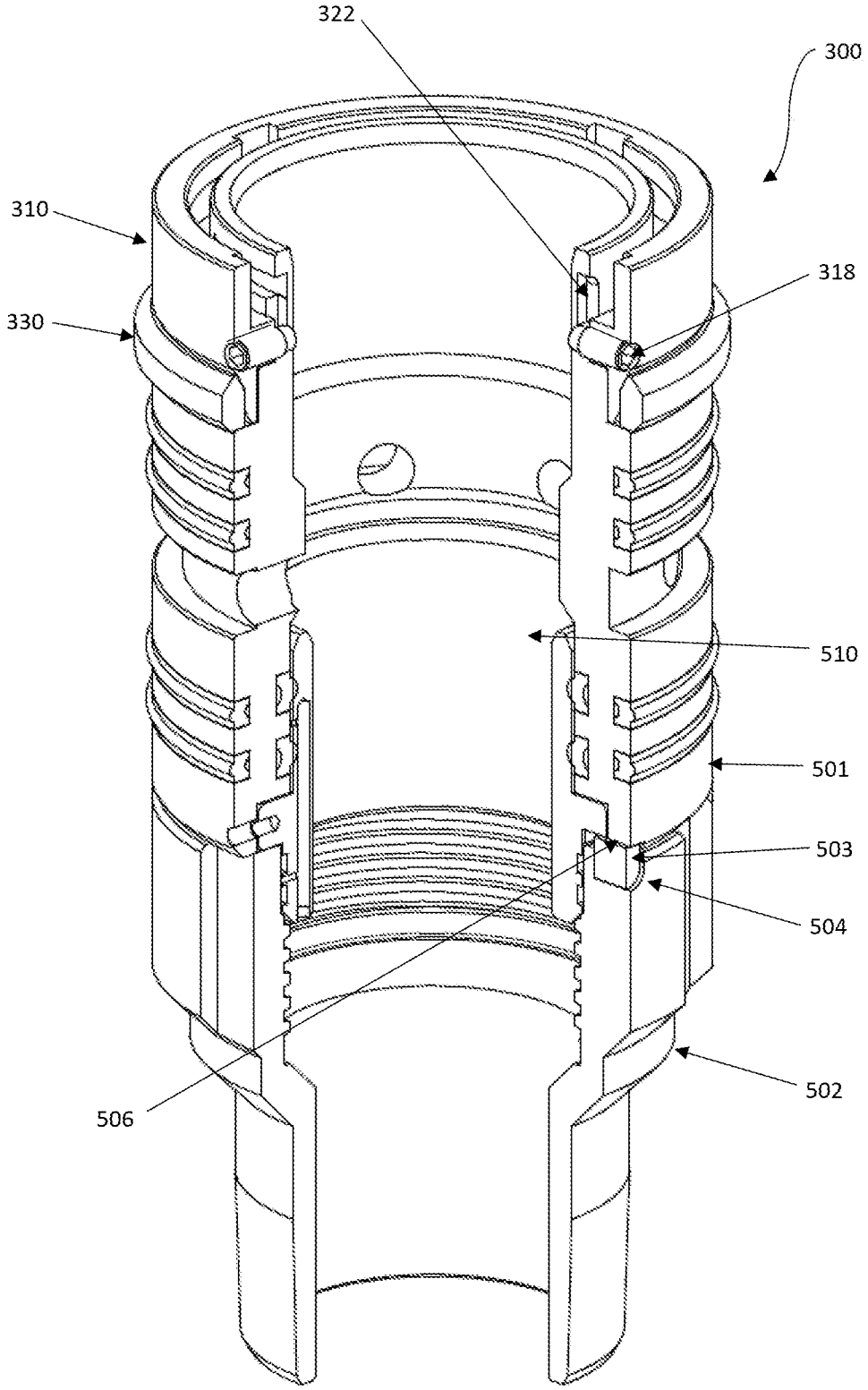
FIG. 5 depicts a perspective cutaway view of a first alternate embodiment of the invention.

Referring now to FIG. 5, the first alternate embodiment of the invention 300 is depicted. Here, an activator ring 310, open lock ring 330 and a plurality of set screws 318 disposed in Z slots 322 are depicted where a lower pack off 501 is the element of the invention 300 into which the Z slots 322 are disposed. This embodiment of the invention 300 shows a lower pack off 501 workably affixed to a lower casing hanger 502 in the same manner that FIG. 6 depicted the assembly of the upper pack off 602 to the upper casing hanger 602. That is, as depicted in FIG. 5, a plurality of tabs 503 identical in shape to the tabs 604 depicted in FIG. 6 are disposed in tab holes 504 disposed in the lower casing hanger 502. The tabs 503 and tab holes 504 are disposed between assembled elements of the invention 300 to prevent or limit rotation between the invention elements in which they are used.

FIG. 5 further discloses the use of a removable sleeve 510 disposed within the connected lower casing hanger 502 and lower pack off 501 as shown. The removable sleeve 510 is described in more detail in FIG. 8 and FIG. 9. As before, the first alternate embodiment of the invention 300 is assembled in the same manner as the other embodiments, including the use of the upper mounting piece 301.

Figure 7:
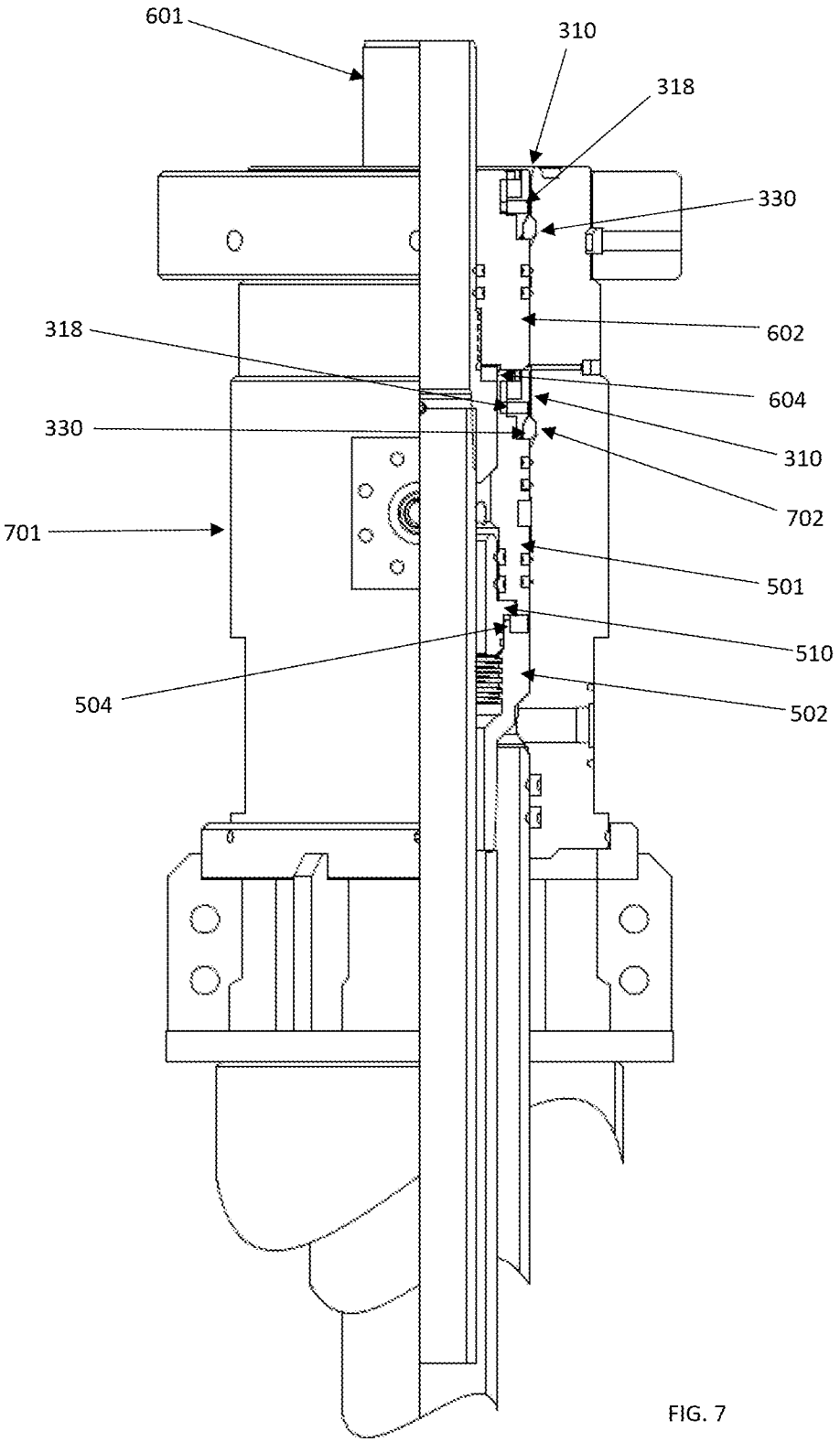
FIG. 7 depicts a partially cutaway side view of the first alternative embodiment and the second alternative embodiment of the invention disposed together in a well head.

Referring now to FIG. 7, two embodiments of the invention 300 (as depicted in FIG. 6 and FIG. 5) are depicted assembled into a single unit within a well head 701. Specifically, from generally top to bottom of FIG. 7, an upper casing hanger 601, tabs 604 set in tab holes 605 of the upper casing hanger 601 and tab slots 606 of the upper pack off 602 are assembled. An activator ring 310 and open lock ring 330 are further assembled, as well as set screws 318. Also depicted are seals and seal grooves known in the industry but which are not claimed, as part of the invention 300. It can be seen this embodiment of the invention 300 is retained in position within the well head 701 by the positioning of the open lock ring 330 in position at the second end 312 of the activator ring 330. In this position, part of the open lock ring 330 extends radially outward from the activator ring 310 and into a groove 702 disposed in the interior surface of the well head 701. Groove 702 is one of a plurality of such grooves disposed within the well head 701 to retain a plurality of open lock rings 330 used with different embodiments of the invention 300. Groove 702 as numbered in FIG. 7 is a groove used to support the placement of the embodiment of the invention 300 depicted in FIG. 5.

Referring still to FIG. 5 and FIG. 7, the first alternative embodiment of the invention 300 is depicted in the well head 701. Therein, a second activator ring 310, open lock ring 330 and set screws 318 are assembled with a lower pack off body 501. The lower pack off body 501 is further assembled with a lower casing hanger 502, removeable sleeve 510 and tabs 503 positioned in tab holes 504 and tab slots 506.

In this manner, one or more oil and gas well tools may be functionally disposed for use within a well head securely, quickly and without the need for high speed rotations.

Figure 8:
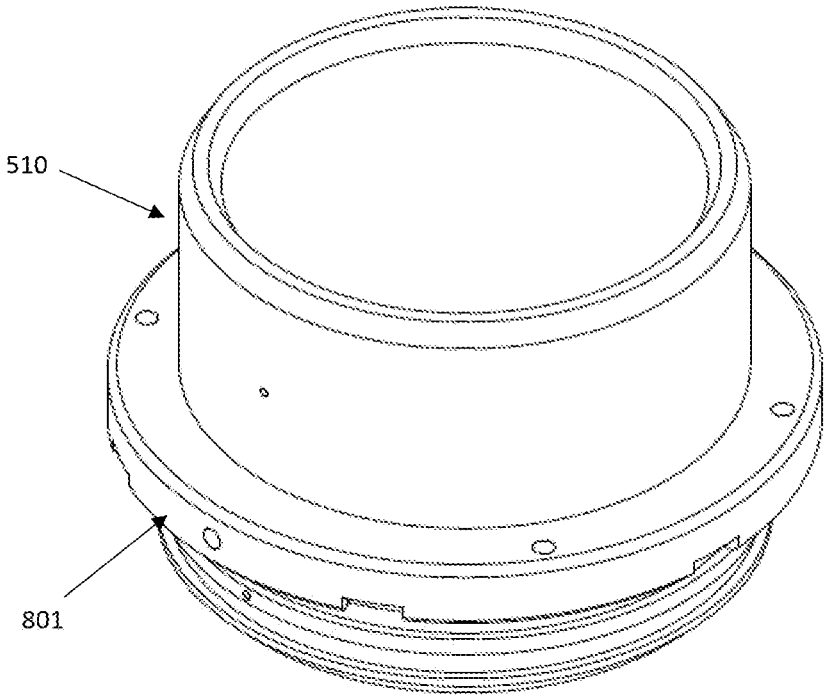
FIG. 8 depicts an upper perspective view of the removeable sleeve used in the primary pack off in the first alternative embodiment of the invention.
Figure 9:
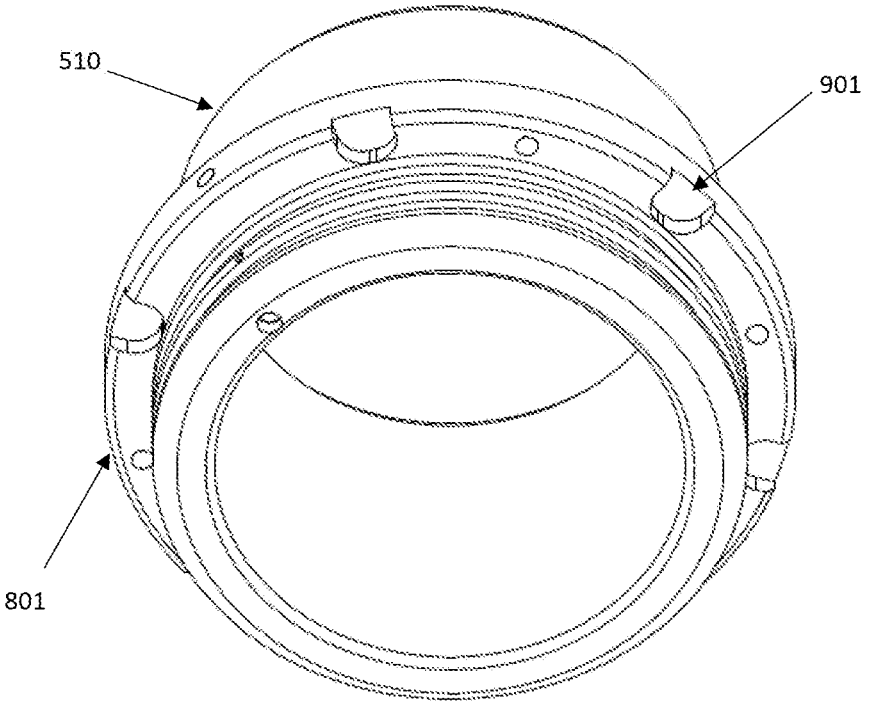
FIG. 9 depicts a lower perspective view of the removeable sleeve used in the primary pack off in the first alternative embodiment of the invention.

Referring now to FIG. 5, FIG. 8 and FIG. 9, removeable sleeve 510 is described. As depicted in FIG. 5, removeable sleeve 510 is disposed in the first alternative embodiment of the invention 300 and serves the primary purpose of providing sealing between elements of the first embodiment of the invention 300. Referring to FIG. 8, removeable sleeve 510 is generally a hollow cylinder in shape and has disposed thereon a flange 801 to aid mounting the removeable sleeve 501 between, relative to the first alternate embodiment, lower pack off body 501 and lower casing hanger 502. Referring to FIG. 9, the flange 801 of the removeable sleeve 501 has disposed on the lower surface thereof a plurality of tab holes 901 each suitable to receive a portion of a tab 504 to retain the removeable sleeve 510 relative to, for example, lower casing hanger 502.

We claim:

1. A device suitable to connect tools in the well head of an oil well without the use of threaded male and female connections, comprising:

a threadless mounting ring having a first end and a second end on which is disposed on the first end a horizontal slot accessible by a plurality of access slots suitable to connect a tool to the first end of the mounting ring;

the tool to be connected to the first end of the mounting ring has disposed thereon a plurality of tabs suited to fit through the plurality of access slots and into the horizontal slot of the first end of the mounting ring;

a shaped second end of the mounting ring;

a plurality of threaded holes each suitable to receive a set screw;

a threadless tool suitable to be connected to the shaped second end of the mounting ring, the tool having disposed thereof a plurality of Z slots sized to receive the set screws threaded into the plurality of threaded holes of the mounting ring; and an open ring sized to be secured on the second end of the mounting ring to retain the assembled device in place in a well head.

2. The invention of claim 1 in which the open ring is shaped to be pressed onto the shaped second end of the mounting ring by compression between the mounting ring and the tool assembled onto the second end of the mounting ring.

3. The invention of claim 2 in which the open ring disposed on the second end of the mounting ring is shaped to be securable into a machined groove of a well head.

4. The invention of claim 1 further comprising a mounting piece having a first end and a second end in which the second end of the mounting piece is suitable to be removeably connected to the first end of the mounting ring to aid assembly of the invention and well head tools in a well head.

* * * * *